US005368402A

United States Patent [19]

Takahashi et al.

[11] Patent Number: 5,368,402

[45] Date of Patent: Nov. 29, 1994

[54] SERIAL PRINTER CAPABLE OF PROMPTLY DETECTING ABNORMALITY IN HEAD CARRIAGE MOVEMENT

[75] Inventors: Toyohiro Takahashi; Masami Furuya; Toshio Koyama; Kenichi Owa, all of Kanagawa, Japan

[73] Assignee: Fuji Xerox Co., Ltd., Tokyo, Japan

[21] Appl. No.: 74,751

[22] Filed: Jun. 10, 1993

[30] Foreign Application Priority Data

Jun. 11, 1992 [JP] Japan ..... 4-151999

[51] Int. Cl.[5] ..... B41J 29/42

[52] U.S. Cl. ..... 400/279; 400/320; 400/705; 400/705.1

[58] Field of Search ..... 400/320, 705.1, 705, 400/279; 318/640

[56] References Cited

U.S. PATENT DOCUMENTS 4,305,674 12/1981 Velazquez ..... 400/320
4,338,035 7/1982 Kondo et al. ..... 400/320
4,652,159 3/1987 Nagai ..... 400/320
4,789,874 12/1988 Majette et al. ..... 400/320
4,802,777 2/1989 Yamada ..... 400/705.1
4,838,717 6/1989 Ogura ..... 400/705.1
5,087,134 2/1992 Tanuma et al. ..... 400/54

FOREIGN PATENT DOCUMENTS 57-174291 10/1982 Japan .

*Primary Examiner*—Edgar S. Burr
*Assistant Examiner*—John S. Hilten
*Attorney, Agent, or Firm*—Finnegan, Henderson, Farabow, Garrett & Dunner

[57] ABSTRACT

A movement distance monitoring pulse counter counts drive pulses being applied to a carriage-moving pulse motor, and produces a count value M. An optical sensor attached to a head carriage detects slits of a slit encoder passed by the head carriage. A slit counter counts output pulses of the optical sensor, and produces a reset signal every time the count reaches a preset number of output pulses corresponding to a monitoring carriage movement distance. The count value M is reset in response to the reset signal. When the count value M exceeds a preset number of drive pulses corresponding to the monitoring carriage movement distance, an abnormality detection signal is produced.

6 Claims, 5 Drawing Sheets

SERIAL PRINTER CAPABLE OF PROMPTLY DETECTING ABNORMALITY IN HEAD CARRIAGE MOVEMENT

BACKGROUND OF THE INVENTION

The present invention relates to a serial printer having a carriage-moving pulse motor for reciprocating, in the main scanning direction, a head cartridge on which a printing head is mounted. More specifically, the invention relates to a serial printer having a function of monitoring whether the head carriage is correctly moving by a distance that is in accordance with the number of carriage drive pulses being applied to the carriage-moving pulse motor.

A conventional serial printer of the above type is disclosed in Japanese Patent Application Unexamined Publication No. Sho. 57-174291. In this serial printer, the number of pulses necessary for one scanning line reciprocation of the head carriage is stored in advance, and abnormality in the head carriage driving is detected by comparing the number of pulses actually sent to the carriage-moving motor with the stored number of pulses.

However, this method is deficient in that abnormality of the head carriage movement cannot be detected until the head carriage finishes its one reciprocation. The delay of the abnormality detection may cause serious damage to the carriage-moving pulse motor, recording sheet, etc.

SUMMARY OF THE INVENTION

An object of the present invention is to provide a serial printer using a pulse motor as a carriage-moving motor which can promptly detect abnormality in the movement of a head carriage. According to the invention, a serial printer comprises:

- a pulse motor for reciprocating a head carriage in a main scanning direction;
- means for generating drive pulses for the pulse motor;
- means for counting the drive pulses to produce a drive pulse count;
- means for detecting a movement distance of the head carriage in the main scanning direction, and for resetting the drive pulse count every time the head carriage movement distance reaches a preset monitoring distance which is shorter than a movable distance of the head carriage in the main scanning direction;
- means for storing a preset number of the drive pulses which corresponds to the preset monitoring distance; and
- means for judging that movement of the head carriage is abnormal when the drive pulse count exceeds the stored preset number.

DESCRIPTION OF THE PREFERRED EMBODIMENT

An embodiment of a serial printer according to the present invention is hereinafter described with reference to the accompanying drawings.

Figure 1:
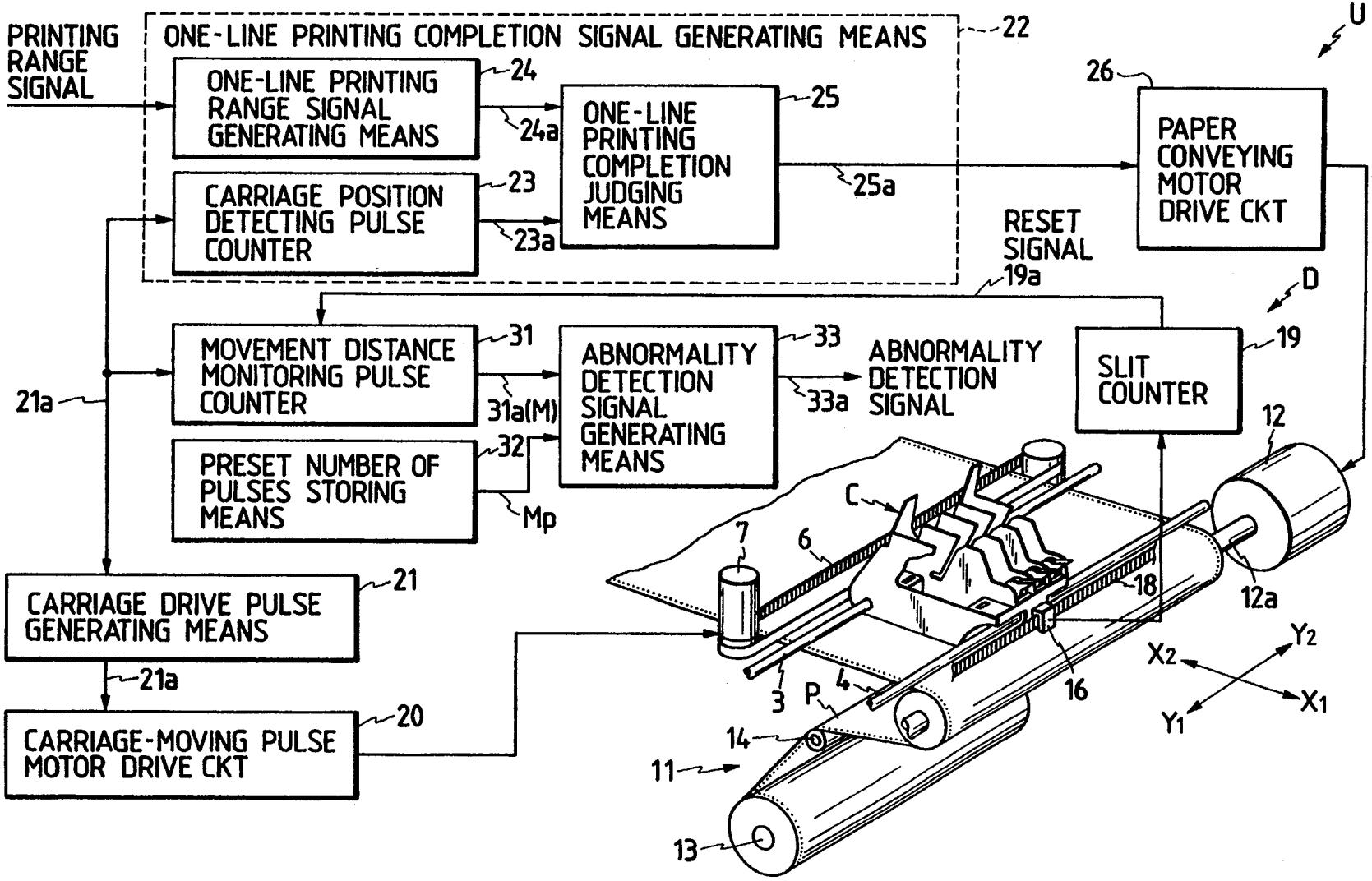
FIGS. 1 and 2 show a serial printer according to an embodiment of the present invention.
Figure 2:
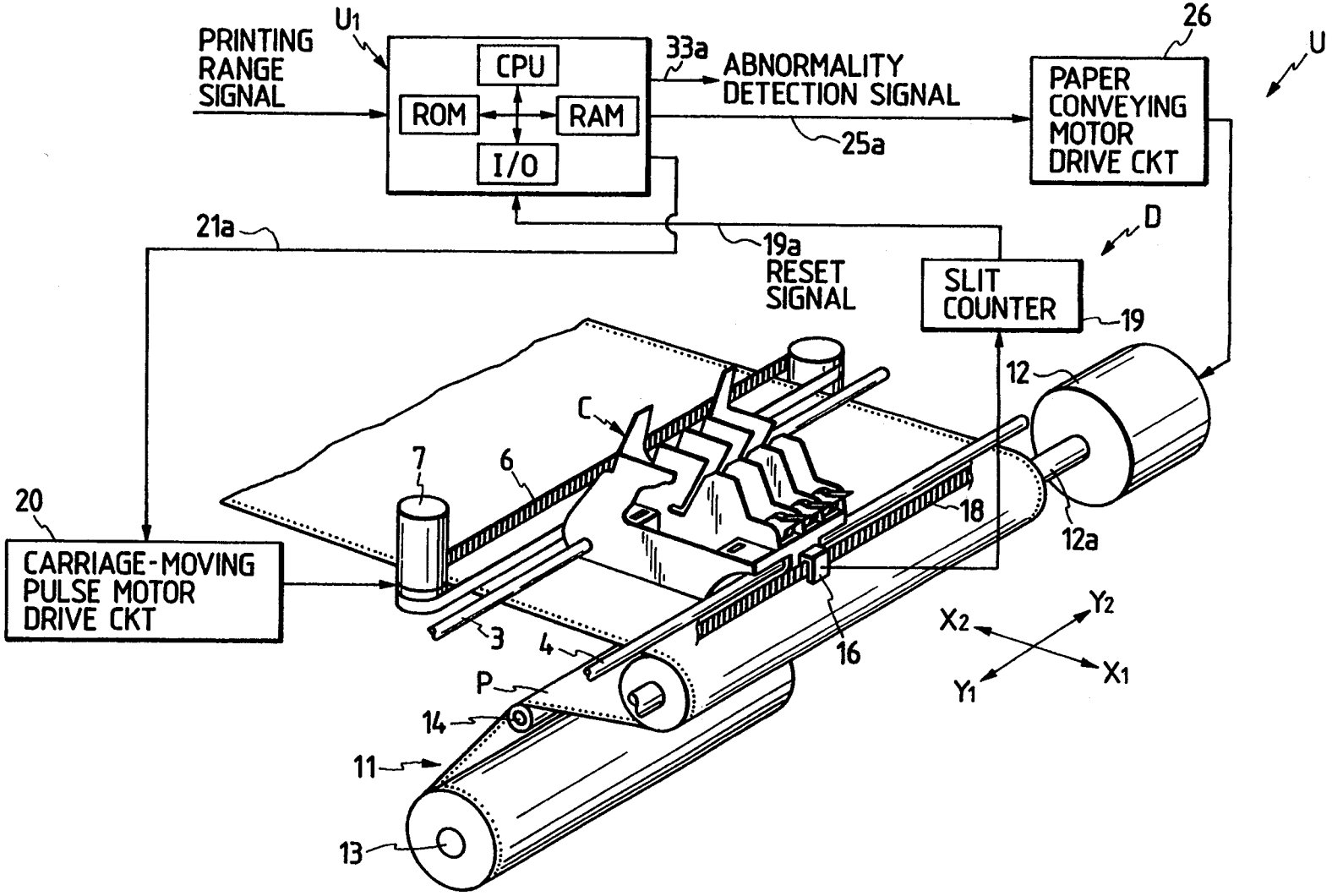
Figure 3:
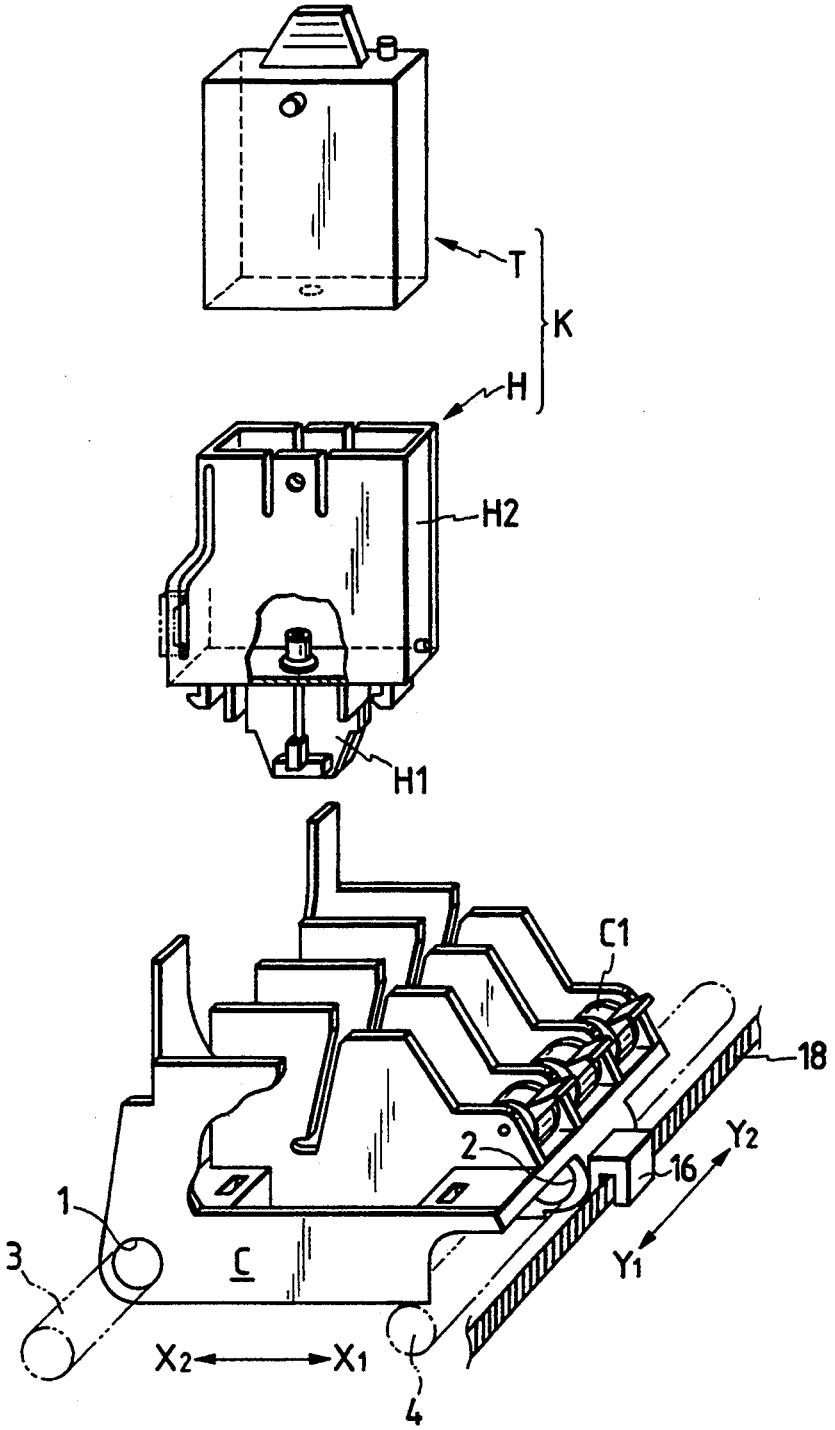
FIG. 3 is a perspective view showing a head carriage and an ink jet cartridge to be mounted thereon.
Figure 4:
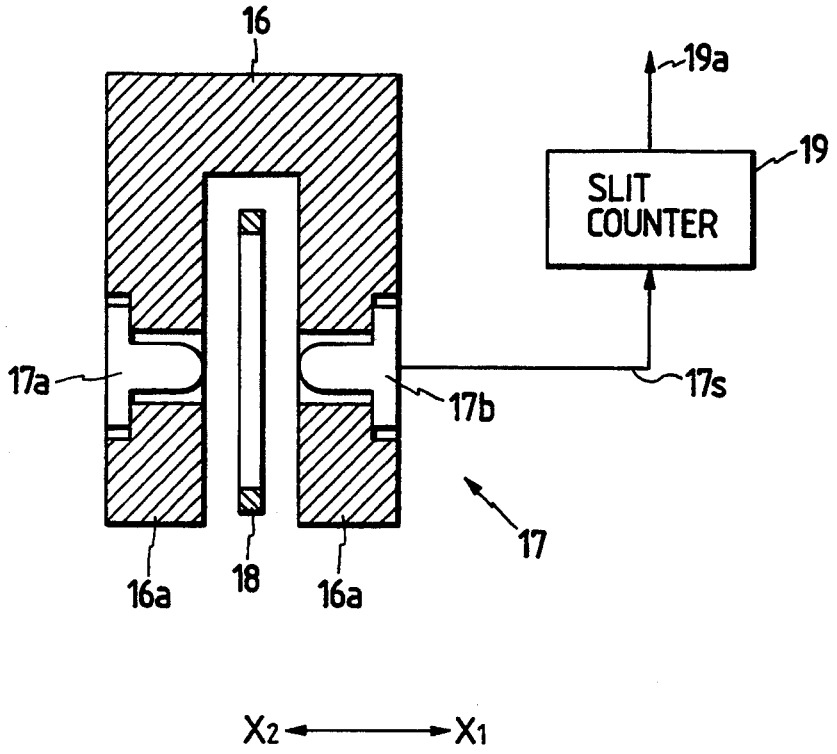
FIG. 4 shows details of a carriage movement distance detecting means.
Figure 5:
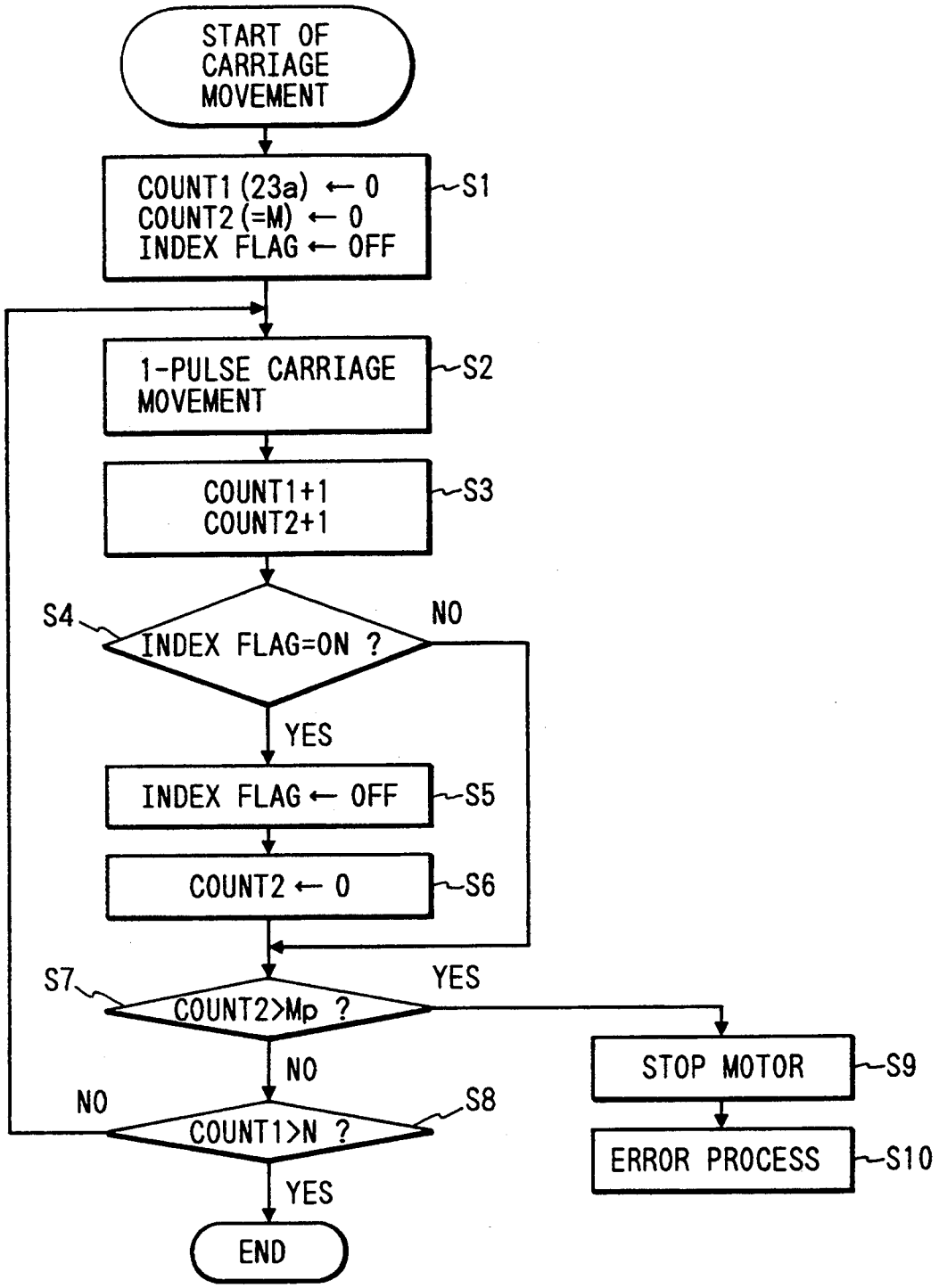
FIG. 5 is a flowchart showing the operation of the serial printer.

FIGS. 1 and 2 show a serial printer according to an embodiment of the invention. While in FIG. 1 a control section of the serial printer is shown as function blocks, it is shown in FIG. 2 as circuit components of a microcomputer for implementing the functions of the control section. FIG. 3 shows in detail a head carriage C of FIGS. 1 and 2, and an ink jet cartridge K to be mounted thereon. FIG. 4 shows details of a carriage movement distance detecting means D. FIG. 5 is a flowchart showing the operation of the serial printer.

As shown in FIG. 1, an ink jet printer U has a head carriage C, which is so constructed as to accept four ink jet cartridges K for jetting, through their jetting nozzles, respective inks of yellow, magenta, cyan and black to perform printing.

As shown in FIG. 3, the ink jet cartridge K (only one cartridge is shown in FIG. 3) of each color consists of a head cartridge H and an ink tank T detachable to it. The head cartridge H consists of an ink jet recording head H1 and a tank holder H2 to which the ink tank T is detachably mounted. After placed on the head carriage C, the ink jet cartridge K is fixed to it by pressing the ink jet cartridge K backward (i.e., in the direction X2) by means of rotation of an eccentric cam lever C1.

Various types of conventional head carriages and ink jet cartridges may be used in this invention.

As shown in FIG. 3, guide shaft through-holes 1 and 2 are provided at the rear and front portions, respectively, of the bottom part of the head carriage C, and guide shafts 3 and 4 extending in the right-left direction (Y1-Y2 direction) are slidably fitted into the through-holes 1 and 2, respectively.

As shown in FIGS. 1 and 2, a back side portion of the head cartridge C is connected to an endless timing belt 6. Having a regular arrangement of dents and protrusions, the inner surface of the endless timing belt 6 is engaged with a drive gear (not shown) that is attached to an output shaft of a carriage-moving pulse motor 7. The timing belt 6 is reciprocated by the rotation of the carriage-moving pulse motor 7. As a result, the head carriage C, which is connected to the timing belt 6, is reciprocated accordingly in the right-left direction (Y1-Y2 direction) along the guide shafts 3 and 4.

The above mechanism of reciprocating the head carriage C along the guide shafts 3 and 4 using the timing belt (drive belt) 6 is known.

A paper conveying device 11 for feeding recording paper P to the printing position and ejecting printed recording paper P into an ejection tray (not shown) is disposed below the guide shafts 3 and 4. While the paper conveying device 11 shown in FIGS. 1 and 2 is of a type in which roll paper P is conveyed using a tractor feeder, it may be of another type for conveying cut sheets.

The paper conveying device 11 has a drive shaft **12*a* rotated by a paper conveying motor 12. Sprocket wheels (not shown), which are known, having protrusions to engage with holes formed at the right and left ends of the roll paper P are attached to the drive shaft 12*a*. The paper conveying device 11 further has a roll paper attaching shaft 13, a guide roller attaching shaft 14** and other components. Various types of conventional paper conveying devices may be used in this invention.

As shown in FIG. 4 in detail, a sensor support member 16, which is attached to a front end portion of the head carriage C has a pair of sensor support legs 16*a* and 16*b* extending downward and spaced from each other in the front-rear direction (X1-X2 direction). Contained in the respective sensor support legs 16*a* and 16*b* , a light-emitting diode 17*a* and a phototransistor 17*b*, which constitute an optical sensor 17, are opposed to each other with a gap formed in the front-rear direction.

As shown in FIG. 1, a slit encoder 18 is disposed between the light-emitting diode 17*a* and the phototransistor 17*b*, and extends in the right-left direction (Y1-Y2 direction) along the guide shaft 4.

The control section of the serial printer having the above structure is described below.

Referring to FIG. 1, the number of slits passed (traversed) by the head carriage C moving along the slit encoder 18 is detected as the number of output pulses of the phototransistor 17*b* (see FIG. 4) of the optical sensor 17. The output pulses of the phototransistor 17*b* are input to a slit counter 19 as a slit detection signal 17*s* of the optical sensor 17.

The slit counter 19 performs counting on the slit detection signal 17*s* from the start of each one-line scanning by the head carriage C, and outputs a reset signal 19*a* every time the count reaches a preset value Ms. The preset value Ms may be selected from a variety of values, and is 32 in this embodiment.

Therefore, by counting the number of slits passed by the head carriage C, the slit counter 19 detects its movement distance during each one-line scanning, and outputs the reset signal 19*a* every time the head carriage C moves the preset monitoring carriage movement distance A (corresponding to Ms (32) slits) which is shorter than the movable distance in the main scanning direction of the head carriage C.

The components 16–19 constitute the carriage movement distance detection means D.

Referring to FIG. 1, a drive circuit 20 drives the carriage-moving pulse motor 7 in accordance with carriage drive pulses 21*a* provided from a carriage drive pulse generating means 21. The head carriage C is moved one pitch for every carriage drive pulse 21*a*.

In this embodiment, a relationship 3Ns=Np is established, where Np is the number of drive pulses applied to the carriage-moving pulse motor 7 to move the head carriage C over the entire one-line printable range (from the left end to the right end) and Ns is the corresponding number of slits to be counted. In this case, the head carriage C moves the one-slit distance of the slit encoder 18 by its 3-pitch movements in response to 3 carriage drive pulses 21*a*.

The carriage drive pulses 21*a* , that are output from the carriage drive pulse generating means 21, are also provided to a carriage position detecting pulse counter 23 of a one-line printing completion signal generating means 22. The carriage position detecting pulse counter 23 outputs a carriage position signal 23*a* produced by adding a count value of the carriage drive pulses 21*a* from the start of each one-line scanning to a value of a scanning start position signal (i.e., the number of pulses obtained by conversion from a signal indicating a scanning start position with respect to a reference position in the main scanning direction).

The one-line printing completion signal generating means 22 has a one-line printing range signal generating means 24, which generates, for each line, a one-line printing range signal 24*a* (defining a one-line printing range) based on a printing range signal (defining printing ranges) provided from a host computer (not shown).

Further, the one-line printing completion signal generating means 22 has a one-line printing completion judging means 25, which compares the carriage position signal 23*a* with the one-line printing range signal 24*a*, and outputs a one-line printing completion signal 25*a* when the carriage C reaches the end of the one-line printing range.

Thus, the one-line printing completion signal generating means 22 consists of the components 23–25.

The one-line printing completion signal 25*a* is provided from the one-line printing completion judging means 25 to a paper conveying motor drive circuit 26. In response to the one-line printing completion signal 25*a*, the paper conveying motor drive circuit 26 drives the paper conveying motor 12, whereby the recording paper P is fed by a distance corresponding to one-line scanning.

In FIG. 1, the carriage drive pulses 21*a*, that are output from the carriage drive pulse generating means 21, are also provided to a movement distance monitoring pulse counter 31, which counts, for each one-line scanning, the carriage drive pulses 21*a* from the start of the scanning, and outputs the count value M as a detected movement distance signal 31*a*.

In the movement distance monitoring counter 31, the count value M of the carriage drive pulses 21*a* is reset by the reset signal 19*a* provided from the slit counter 19 of the carriage movement distance detecting means D.

The serial printer U of this embodiment has a preset number of pulses storing means 32, which stores a preset number Mp of carriage drive pulses for monitoring. In accordance with the above-described settings of Ms=32 and 3Ns=Np, Mp is set such that Mp=3Ms=96.

The serial printer U also has an abnormality detection signal generating means 33, which compares the value M of the detected movement distance signal 31*a* with the preset number Mp (=96) of carriage drive pulses for monitoring, and outputs an abnormality detection signal 33*a* if M >Mp. The carriage-moving pulse motor 7 is stopped in response to the abnormality detection signal 33*a*.

While the respective functions of the components 21–25 and 31–33 can be implemented by wired logic, in this embodiment they are implemented by a microcomputer U1. FIG. 2 shows an actual control section of this embodiment.

As shown in FIG. 2, the microcomputer U1 consists of a CPU, ROM, RAM, I/O interface and other components. The respective functions of the components 2114 25 and 31–33 of FIG. 1 are implemented by the microcomputer U1 in which programs, data, etc. stored in the ROM are processed by the CPU, RAM, etc.

The microcomputer U1 receives the reset signal 19*a* (from the slit counter 19), printing range signal, printing data, etc., and provides the carriage drive pulses 21*a* to the carriage-moving pulse motor drive circuit 20, and the one-line printing completion signal 25*a* to the paper conveying motor drive circuit 26.

Referring to a flowchart of FIG. 5, the operation of the serial printer having the above constitution is described below. The processing of this flowchart is performed based on programs stored in the ROM of the microcomputer U1.

Upon starting of one-line scanning, COUNT1 (value of the carriage position signal 23*a*) and COUNT2 (value M of the detected movement distance signal 31*a*) are reset to zero in step S1. Further, INDEX FLAG is set to be OFF ("0"). INDEX FLAG is a flag that is made ON when the reset signal 19*a* (produced by the slit counter 19 upon counting of Ms slits) is input to the microcomputer U1. INDEX FLAG serves so that COUNT2 (=M) is increased by one for every input of the carriage drive pulse 21*a* while INDEX FLAG is OFF, and is reset when INDEX FLAG turns ON.

In step S2, when the carriage drive pulse 21*a* is output from the carriage drive pulse generating means 21, the head carriage C is moved by a distance corresponding to one pulse.

In step S3, COUNT1 (23*a*) and COUNT2 (=M) are increased by one.

In step S4, it is judged whether INDEX FLAG is ON. If the judgment is negative, the process goes to step S7. If the judgment is affirmative, the process goes to step S5.

In step S5, INDEX FLAG is made OFF.

In step S6, COUNT2 (=M) is reset to zero.

In step S7, it is judged whether COUNT2 (=M) is larger than Mp (=96). An affirmative judgment in step S7 means that although the carriage drive pulses 21*a* of more than Mp have been output, the head carriage C has not moved by the distance corresponding to the number Ms (=32=Mp/3) of slits of the slit encoder 18; that is, some abnormality has occurred in the movement of the head carriage C.

If the judgment of step S7 is affirmative, the process goes to step S9. If the judgment is negative, the process goes to step S8.

In step S8, it is judged whether COUNT1 (23*a* ) is larger than a value N of the one-line printing range signal. The value N depends on the size of the printing paper, and is stored in the RAM of the microcomputer U1 when the paper size is determined through a console panel, etc.

If the judgment in step S8 is negative, the process returns to step S2. If the judgment is affirmative, the one-line movement of the head carriage C is finished, and scanning of the next line is started.

The carriage-moving pulse motor 7 is stopped in step S9, and an error process is effected in step S10. For example, the error process is such that a warning lamp (LED etc.) on the console panel is turned on to prompt a user to check the printer.

The invention is not limited to the above embodiment, but various modifications are possible.

For example, the invention can be applied to serial printers other than the ink jet printer. The invention can be applied to serial printers in which cut sheets, rather than continuous paper, are conveyed.

The locations and the number of the detection ranges of the monitoring carriage movement distance A can be set freely in the one-line scanning range, and can be modified easily. Even in the case of a serial printer that performs printing in both of the go and return scans by the head carriage C, the detection ranges of the monitoring carriage movement distance A can be set properly for the scan of each direction.

Further, the ratio of the head carriage movement by one carriage drive pulse to the slit interval of the slit encoder 18 may be set at m:n (m and n are arbitrary integers) rather than 1:3. If m:n is set at 1:1, Np (the number of carriage drive pulses necessary for the printing over the entire one-line printable range (from the left end to the right end)) becomes equal to Ns (the corresponding number of slits of the slit encoder 18 passed by the head carriage C). In this case, the preset number Ms of slits of the monitoring carriage movement distance A is equal to the preset number Mp of carriage drive pulses for monitoring; that is, Ms=Mp. Therefore, Mp can be changed easily when the distance A is changed. Further, even in the case where the printing range in the main scanning direction varies depending on the scanning lines and the scanning start position varies accordingly, the carriage movement distance from the scanning start position can be detected for each scanning line.

The carriage position detecting pulse counter 23 may be provided with a function of correcting the count value 23*a* of the carriage drive pulses 21*a* based on a precise carriage movement distance signal output from the slit counter 18 of the carriage movement distance detecting means D (see FIG. 1).

According to the invention, as described above, it becomes possible to detect, for each one-line scanning, abnormality in the movement of the head carriage. Abnormality in the head carriage movement can be detected even in the midst of one-line scanning.

The monitoring carriage movement distance A may be set at an arbitrary value within a proper range. By setting the distance A at a small value within a proper range, it becomes possible to promptly detect abnormality in the movement of the head carriage.

What is claimed is:

1. A serial printer comprising:

ahead carriage;

a pulse motor for reciprocating said head carriage in a main scanning direction;

means for generating drive pulses for the pulse motor;

means for counting the drive pulses to produce a drive pulse count;

means for storing a preset number of the drive pulses, the stored preset number corresponding to a preset monitoring distance, said preset monitoring distance being less than a distances said pulse motor would move the head carriage in the main scanning direction if driven the preset number of drive pulses;

encoder means for generating monitoring pulses;

means for detecting a movement distance of the head carriage in the main scanning direction as a function of the encoder means generating said monitoring pulses, each monitoring pulse corresponding to a physical displacement of the head carriage in response to a multiple of the drive pulses;

means for resetting the drive pulse count when the drive pulse count produced by the means for counting the drive pulses equals the stored preset number and the head carriage has moved at least said monitoring distance; and means for judging that movement of the head carriage is abnormal when the drive pulse count exceeds the stored preset number and the head carriage has not moved at least said preset monitor distance.

2. The serial printer of claim 1, wherein the detecting means comprises a slit encoder disposed along the main scanning direction and having slits arranged in the main scanning direction at regular intervals, an optical sensor attached to the head carriage, for generating a monitoring pulse every time the optical sensor passes one of the slits, and a counter for counting the monitoring pulses.

3. The serial printer of claim 2, wherein the interval of the slits of the slit encoder is equal to a movement distance of the head carriage by one drive pulse.

4. The serial printer of claim 1, further comprising means for generating a signal indicating completion of one-line printing, and means for feeding recording paper in a sub-scanning direction in response to the one-line printing completion signal.

5. The serial printer of claim 4, wherein the one-line printing completion signal generating means comprises:

means for generating a signal indicating a one-line printing range based on a printing range signal that is externally provided;

a counter for counting the drive pulses to produce a second drive pulse count; and means for generating the one-line printing completion signal by comparing the second drive pulse count with the one-line printing range signal.

6. The serial printer of claim 5, wherein the detecting means generates a signal indicating a position of the head carriage, and the counter adjusts the second pulse count based on the head carriage position signal.

* * * * *